US006901636B2

(12) United States Patent
Kim

(10) Patent No.: US 6,901,636 B2
(45) Date of Patent: Jun. 7, 2005

(54) RETAIL DISPLAY STRAP FOR SECURING A TIE TO A SHIRT

(75) Inventor: Cin Kim, Montvale, NJ (US)

(73) Assignee: Peacock Apparel Group, Inc., New York, NY (US)

( * ) Notice: Subject to any disclaimer, the term of this patent is extended or adjusted under 35 U.S.C. 154(b) by 22 days.

(21) Appl. No.: 10/250,158

(22) Filed: Jun. 9, 2003

(65) Prior Publication Data

US 2004/0244154 A1 Dec. 9, 2004

(51) Int. Cl.[7] ..... B65D 63/00

(52) U.S. Cl. ..... 24/17 A; 24/16 PB; 24/30.5 P; 24/17 R

(58) Field of Search ..... 24/16 PB, 17 AP, 24/17 A, 17 R, 30.5 R, 30.5 P, 306; 220/682, 683, 686; 206/425

(56) References Cited

U.S. PATENT DOCUMENTS

| | | | | | |
|---|---|---|---|---|---|
| 520,145 | A | * | 5/1894 | Newman | 24/17 A |
| 1,266,275 | A | * | 5/1918 | Kelley | 24/17 A |
| 1,719,618 | A | * | 7/1929 | Novick | 24/17 R |
| 1,829,613 | A | * | 10/1931 | Ryuji | 24/17 AP |
| 1,986,649 | A | * | 1/1935 | Steele | 24/17 R |
| 2,004,098 | A | * | 6/1935 | Andrews | 24/17 R |
| 2,156,583 | A | * | 5/1939 | Chaplin | 24/17 R |
| 2,286,181 | A | * | 6/1942 | Steele | 24/17 R |
| 3,662,434 | A | * | 5/1972 | Clayton | 24/30.5 P |
| 3,942,192 | A | | 3/1976 | Harris | |
| 3,997,943 | A | * | 12/1976 | Jones et al. | 24/30.5 P |
| 4,466,159 | A | * | 8/1984 | Burrage | 24/16 PB |
| 4,942,644 | A | * | 7/1990 | Rowley | 24/16 PB |
| 5,170,507 | A | | 12/1992 | Langford et al. | |
| 5,289,619 | A | * | 3/1994 | Pileggi | 24/17 AP |
| 5,416,926 | A | | 5/1995 | Koy | |
| 5,983,461 | A | | 11/1999 | Chen | |
| 6,216,275 | B1 | | 4/2001 | Lee | |
| 6,510,590 | B1 | | 1/2003 | Lin | |

OTHER PUBLICATIONS

A computer printout of a photograph depicting a device used by assignee as of May 22, 2003.

* cited by examiner

*Primary Examiner*—Robert J. Sandy
(74) *Attorney, Agent, or Firm*—Darby & Darby

(57) ABSTRACT

For use with a shirt and tie combination, provided is a strap comprising an elongated body, and two scorelines defining a space therebetween, wherein the elongated body is foldable along the scorelines. Also provided are two lock-tabs and two lock-slots. The two lock-tabs are able to engage the two lock-slots when the elongated body is folded, and thus two lock-joints are formed. A channel is defined by the elongated body between the two lock-joints, the channel being sized for the placement of the tie. Also provided is a method for securing a tie to a folded shirt. The tie is attached to the neck area of the shirt. The tie is positioned along the buttons of the shirt. A strapping device is wrapped around the shirt. The tie is inserted into the strapping device. The tie and the shirt are secured free of a surrounding bag.

9 Claims, 4 Drawing Sheets

RETAIL DISPLAY STRAP FOR SECURING A TIE TO A SHIRT

BACKGROUND OF THE INVENTION

Retailers are discovering that shirt and tie combinations packaged together better meet the needs of a certain class of shoppers. When displaying and selling dress shirts in combination with ties, retailers assist their clients with a fashion choice that can be time consuming. Furthermore, when suitably coordinated, a shirt and a tie combination can make a more attractive display item for sale than if displayed individually.

Unfortunately, some consumers tend to remove and replace ties from their previously associated shirt, and thus create additional costs and difficulties to the retailer. Among other problems created, the individual components are not separately priced. Thus, retailers would benefit from a way to package shirt and tie combinations so that the consumer is discouraged from removing ties from these combinations.

SUMMARY OF THE INVENTION

The present invention is a display strap for securing a tie to a shirt. In one aspect the present invention comprises an elongated body extending in a first direction between first and second ends. The elongated body has two scorelines, generally perpendicular to the first direction and defining a space therebetween. The elongated body is foldable along the scorelines, and the spaced between is sized to accommodate a folded shirt.

Two lock-tabs are positioned adjacent to the ends. Also, two lock-slots are positioned along the elongated body—a first one between the first end and the first scoreline and a second one between the second end and the second scoreline. The portions of the body between each scoreline and its respective end are long enough to allow the first and second lock-tabs to engage the second and first lock-slots respectively, when the body is folded along the scorelines. When such an engagement is made, two lock-joints are formed and a channel is formed, the channel being defined by the elongated body between the lock-joints. The channel is suitable for the placement of a tie therein.

In another aspect of the present invention, two elongated bodies are used. A first elongated body extends in a first direction between a first end and a second end. A second elongated body extends in the first direction between a third and a fourth end. Also provided are first and second scorelines extending in a direction generally perpendicular to the first direction and placed on the first and second elongated bodies respectively, each elongated body being foldable along its respective scoreline, and each scoreline defining two portions of its respective elongated body. Further provided are first, second, third and fourth lock-tabs positioned respectively adjacent to the first, second third and fourth ends of the two elongated bodies. In addition, first and second lock-slots are each positioned along the second elongated body and third and fourth lock-slots, each positioned along the first elongated body. When the two elongated bodies are folded along their respective scorelines, they attach to one another by way of first and second pairs of lock-joints, the first pair of lock-joints comprising (a) the first lock-tab and the first lock-slot and (b) the third lock-tab and the third lock-slot, the second pair of lock-joints comprising (a) the second lock-tab and the second lock-slot and (b) the fourth lock-tab and the fourth lock-slot. After such a folding two channels are present—the first channel being defined by the first and second elongated bodies between the first pair of lock-joints and the second channel being defined by the first and second elongated bodies between the second pair of lock-joints. Each channel is sized for the placement of a tie therein.

In another aspect of the present invention, a fabric strap comprising an elongated body extending in a first direction and having a first end and a second end is provided. The first end is bound to a first binding point which is positioned along the elongated body and is proximal to the second end, and the second end is bound to a second binding point which is positioned along the elongated body and is proximal to the first end, wherein a main loop sized for the placement of the shirt therein is defined between the first end of the elongated body and the second binding point a channel sized for the placement of the tie therein is defined between the first and second binding points.

In another aspect of the present invention, provided is a fabric strap comprising an elongated body extending in a first direction and having a first end and a second end bound to one another so as to define a main loop sized for the placement of the shirt therein. A wall extends in the first direction along a portion of the elongated body between first and second attachment points at which points the wall is attached to the elongated body. The first and second attachment points define therebetween a channel sized for the placement of a tie therein.

Another aspect of the present invention is a method for securing a tie to a folded shirt having buttons down the front thereof. The tie is attached to the neck area of the folded shirt. It is positioned along the buttons of the folded shirt. A strapping device is wrapped around the folded shirt. The tie is inserted into the strapping device. This method provides that the tie and folding shirt are secured free of surrounding bag for retail display.

DETAILED DESCRIPTION EXEMPLARY EMBODIMENTS

Figure 1:
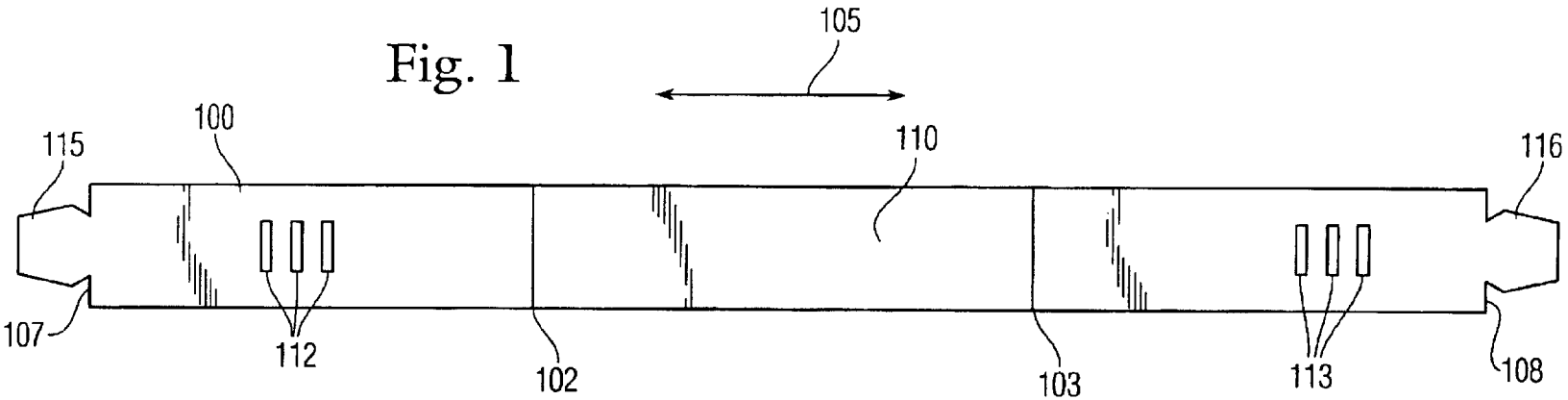
FIG. 1 is a depiction of a first embodiment of the present invention in an unfolded state.
Figure 2:
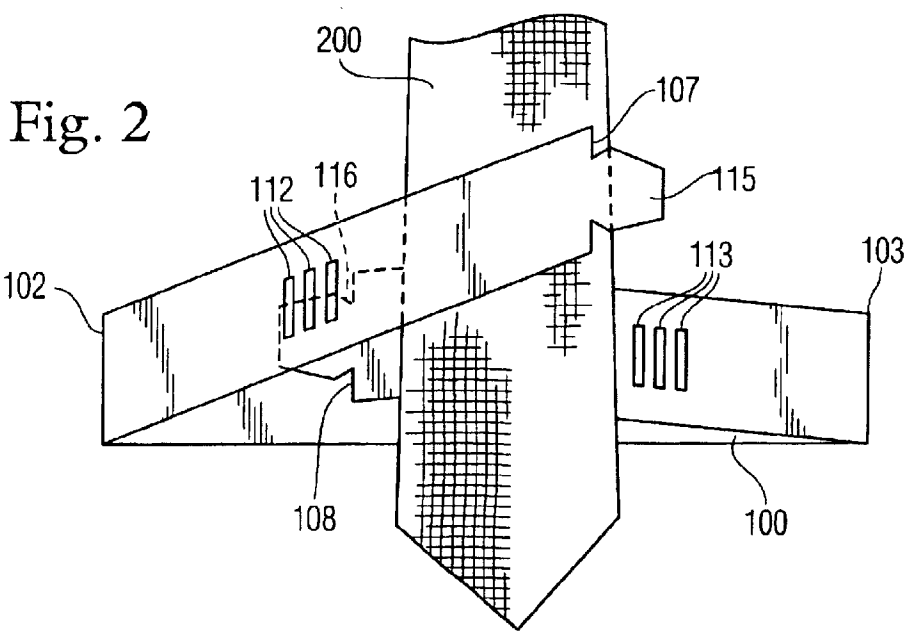
FIG. 2 is a depiction of the first embodiment in a folded state.

The main component of the present invention is the body 100, shown in FIG. 1 in an unfolded state and in FIG. 2 in a folded state. The body 100 folds along scorelines 102 and 103. The scorelines are indentations that are either created as part of the manufacture of the body or are the result of the folding of the body.

The body extends in horizontal direction, marked by arrow 105, between ends 107 and 108. The body may be manufactured in variety of materials. In a preferred embodiment, plastic is used. Also, in a preferred embodiment, the body is manufactured from a clear material in order to reveal a shirt and a tie beneath it. Furthermore, in a preferred embodiment, the body 100 includes indicia, for example, placed on the portion 110 between the scorelines 102 and 103. Indicia may include trade names and/or describe the merchandise with which the present invention is used.

The body 100 also includes a set of first lock-slots 112 and a set of second lock-slots 113. The two sets comprise one or more lock-slots each. Multiple lock-slots help accommodate shirts of different dimensions. A first lock-tab 115 is placed next to the first end 107 and a second lock-tab 116 is placed next to the second end 108.

The present invention is used in conjunction with a folded shirt (300 in FIG. 3 ) with a tie (200 in FIG. 2 ) attached to it. When folded along the scorelines 102 and 103, the body can be made to wrap around the shirt, as shown in FIG. 2 . In a preferred embodiment, the tie is folded to span portions of the top and bottom surfaces of the shirt. The body is placed in a position so that it intersects the tie at least once (and preferably twice—on the top and the bottom of the folded shirt).

Figure 3:
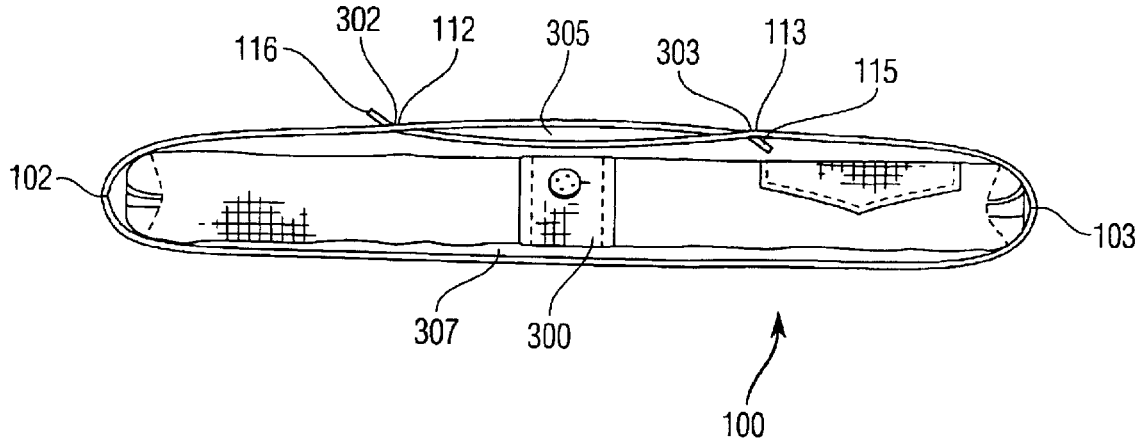
FIG. 3 is an end view of the first embodiment in a folded state.

When the body is folded, as shown in FIG. 2, the second lock-tab 116 is inserted in one of the first slots 112 and the first lock-tab 115 is inserted in one of the second slots 113. FIG. 3 shows a view from below of the body 100 wrapped around a folded shirt 300. There it can be seen that when lock-tab 116 inserted into lock-slot 112 a lock-joint 302 is formed. Similarly, when lock-tab 115 is inserted into lock-slot 113, lock-joint 303 is formed. The ends 107, 108 remain fixed to define the channel 305 because the lock tabs preferably include at least a portion that is larger than the lock slots. When these insertions are made, the channel 305 defined between the lock-joints 302 and 303 and portions of the body is suitable for the insertion of a tie therein. In a preferred embodiment the channel is so formed that it provides frictional resistance to the tie once a tie is placed therein. Thus, once a tie is placed within the channel one must exert a force on the tie in order to pull it out.

If the tie is placed so it intersects the body twice, then the other end of the tie is placed in the space between the body and the folded shirt 307.

Figure 4:
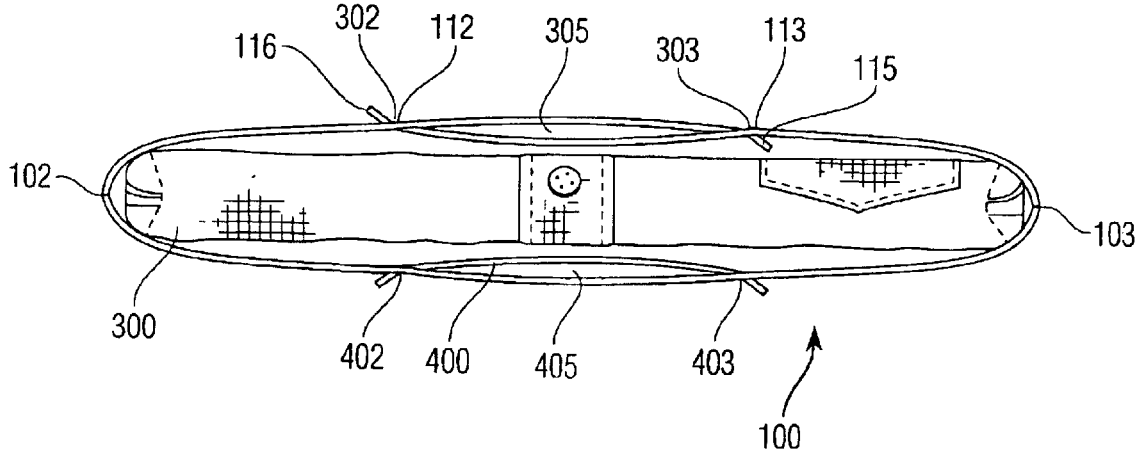
FIG. 4 is an end view of a variation of the first embodiment.

FIG. 4 depicts a different embodiment of the present invention. There, a strip 400 is added to the side of the folded body that is opposite to the channel 305. The strip 405 is attached to the body 100 by joints 402 and 403. These joints may be created by the described lock-tab and lock-joint method or by any other method, such as, for example, the use of glue. In FIG. 4 the strip 400 is placed between the body 100 and the folded shirt 300. It may, however be placed on the other side, so that the body 100 is between the strip 400 and the shirt 300. The strip helps form a second channel 405, which is also suitable for the placement of a tie therein. Thus, in cases where the i.e., is folded in such a way as to intersect the body twice, the tie is placed within the first channel 305 and within the second channel 405.

Figure 5A:
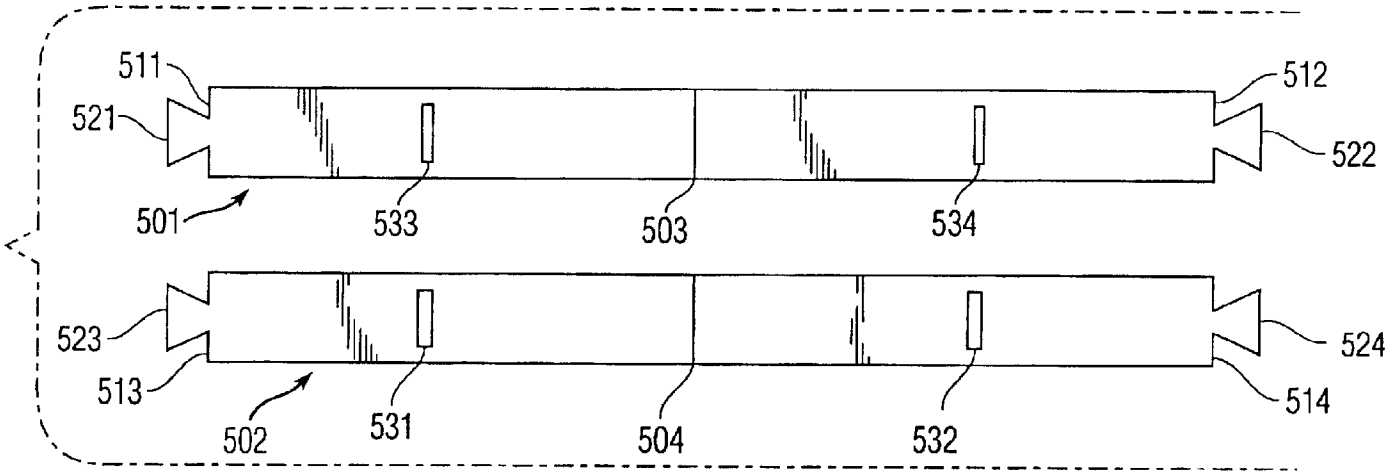
FIG. 5A is a depiction of a second embodiment of the invention in the unfolded state.
Figure 5B:
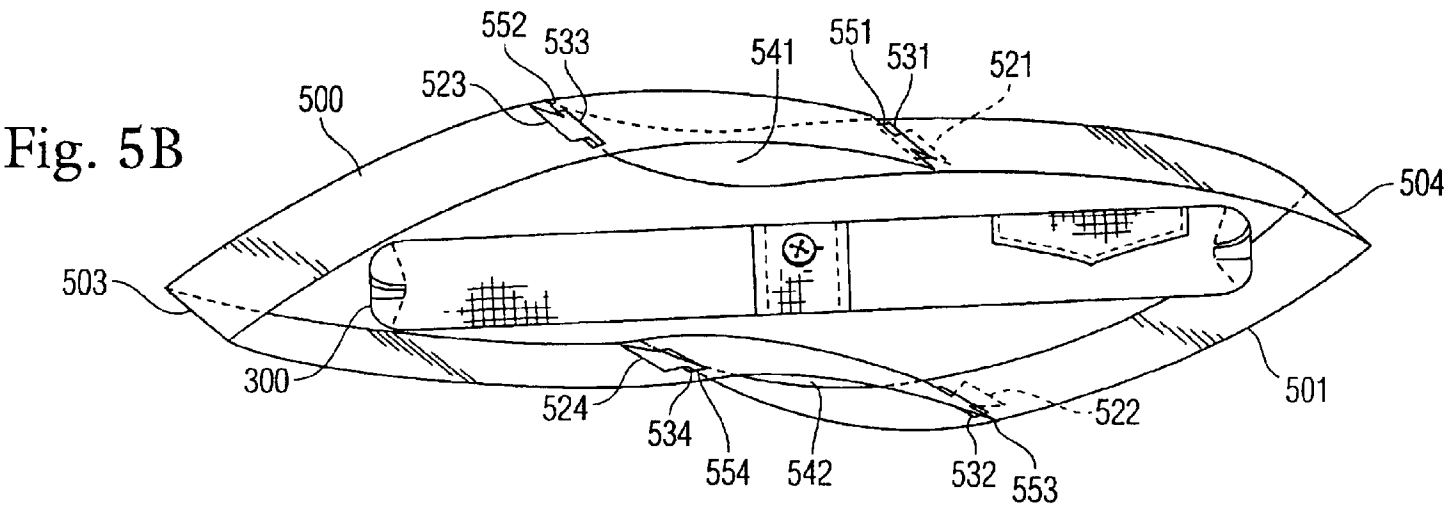
FIG. 5B is a depiction of the second embodiment of the invention in a folded state.

A second embodiment of the invention is depicted in FIGS. 5A and 5B. As seen in FIG. 5A, two elongated bodies 501 and 502 are used. Each elongated body comprises a single scoreline 503 and 504 which is perpendicular to the direction the body extends in. The first elongated body 501 extends between a first end 511 and a second end 512 and the second elongated body 502 extends between a third end 513 and a fourth end 514. There are first, second third and fourth lock-tabs 521, 522, 523 and 524 placed adjacent to the first, second, third and fourth ends 511, 512, 513 and 514 respectively. Each elongated body comprises two lock-slots. The lock-slots of each elongated body are on alternate sides of its scoreline. First and second lock-slots 531 and 532 are positioned on the second elongated body 502. The first lock-slot 531 is proximate to third end 513, and the second lock-slot 532 is proximate to the fourth end 514. Third and fourth lock-slots 533 and 534 are positioned on the first elongated body 500. The third lock-slot 533 is proximate to first end 511, and the fourth lock-slot 534 is proximate to the second end 512.

The two elongated bodies are folded along their respective scorelines and wrapped around a folded shirt 300 as shown in FIG. 5B. The first lock-tab 521 engages the first lock-slot 531 and the third lock-tab 523 engages the third lock-slot 533 to form a first pair of lock-joints 551 and 552, respectively. The second lock-tab 522 engages the second lock-slot 532 and the fourth lock-tab 524 engages the fourth lock-slot 534 to form a second pair of lock-joints 553 and 554, respectively. After the engagements are made and the lock-joints are formed a first and second channels 541 and 542 are formed between the lock-joints and the two elongated bodies. These channels are suitable for the placement of a tie therein. In a preferred embodiment a tie is placed within one of the channels, folded along one of the sides of a folded shirt and placed within the other channel.

Figure 6:
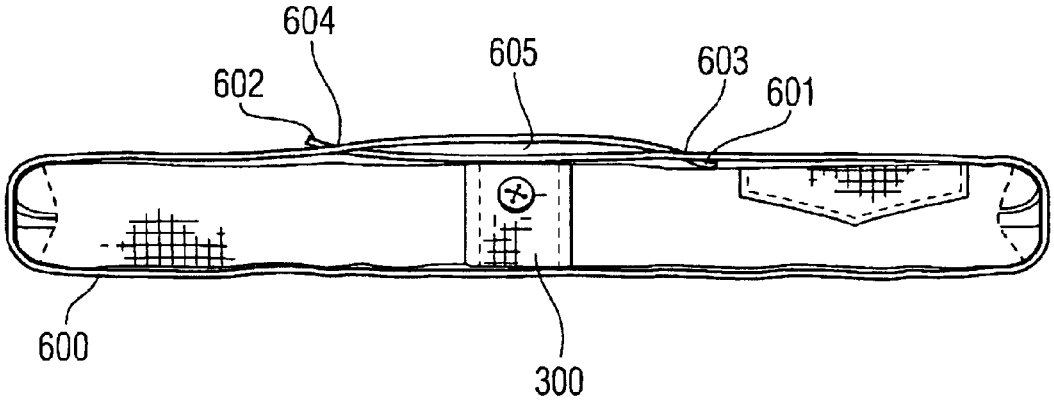
FIG. 6 is a depiction of a third embodiment of the present invention.

A third embodiment of the present invention is depicted in FIG. 6. A fabric elongated body 600 having first and second ends 601 and 603 is used. The elongated body 600 is wrapped around the folded shirt 300 in a way very similar to the way the elongated body 100 of the first embodiment is wrapped. But instead of using lock-tabs and lock-slots, the ends 601, and 602 are attached to binding points 603 and 604, the binding points being positioned on the elongated body. Thus, the elongated body 600 forms a main loop, or a fabric strap, around the folded shirt 300. A channel 605 sized for the placement of a tie therein is formed between the binding points and portions of the strap.

Figure 7:
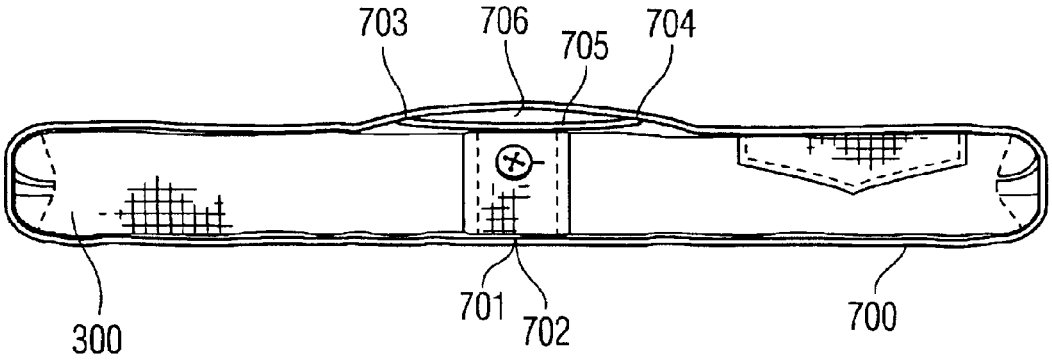
FIG. 7 is a depiction of a fourth embodiment of the present invention.

A fourth embodiment of the present invention is depicted in FIG. 7. In this embodiment a fabric elongated body 700 is used. The elongated body is made to form a main loop by attaching its ends 701 and 702. The main loop is suitable for the placement of a folded shirt 300 therein. An additional wall 705, composed, preferably of the same material as the elongated body 700, is attached to the elongated body 700 at two attachment points 703 and 704. A channel 706 is formed between the elongated body 700, the wall 705 and the attachment points 703 and 704. The channel 706 is suitable for the placement of a tie therein.

In use, a tie is secured to a folded shirt without requiring that the shirt and tie combination be enclosed in a bag, box or other cover. Such enclosure is seen as detrimental to the display characteristics of the shirt and tie combination, because customers often want to feel the fabric of the shirt and/or tie before they buy the combination.

The tie is attached to the neck area of a folded shirt. There are several known methods for effecting such attachment. Pins, or a plastic device may be used for this purpose. The tie is then positioned along the buttons of the folded shirt. A strapping device is wrapped around the shirt. In a preferred, one of the devices described above is used. The tie is inserted into the strapping device. As noted above, the shirt and tie combination is not entirely surrounded by a bag, a shrink-wrap or similar packaging.

The wrapping and inserting steps are optionally performed simultaneously. This can be achieved, for example, when using some of the strapping devices described above. More specifically, referring to FIG. 2, the tie 200 is being placed within the strapping device 100 (i.e. the elongated body), while the action of wrapping the folded shirt with the strapping device 100 is ongoing, that is the lock-tab 116 is being placed in a lock-slot 112 and the lock-tab 115 is about to be placed in a lock-slot 113.

The invention has been described in connection with a particular embodiment thereof but is more broadly defined by the claims appended hereto.

What is claimed is:

1. For use with a shirt and tie combination, a strap comprising:

an elongated body extending in a first direction between a first end and a second end;

first and second scorelines extending generally perpendicular to the first direction and defining a space therebetween, wherein the elongated body is foldable along the first and second scorelines and the space between the scorelines is sized to accommodate a folded shirt;

first and second lock-tabs positioned respectively adjacent to the first and second ends;

a first lock-slot positioned along the elongated body between the first end and the first scoreline;

a second lock-slot positioned along the elongated body between the second end and the second scoreline, wherein a portion between the first scoreline and the first end and a portion between the second scoreline and the second end are sufficiently long to allow the first and second lock-tabs to engage the second and first lock-slots, respectively, when the elongated body is folded along the first and second scorelines, and thus form first and second lock-joints;

a channel, defined by the elongated body between the first and second lock-joints, the channel being sized for the placement of the tie therein.

2. The strap of claim 1, wherein the elongated body comprises a clear material.

3. The strap of claim 2, further comprising indicia on the elongated body.

4. The strap of claim 1 wherein the lock-tabs comprise in part a flexible finger which includes a portion that is larger than the lock-slots.

5. The strap of claim 1, wherein the lock-slots comprise an oval shaped aperture.

6. The strap of claim 1, wherein the first scoreline is more proximate to the first end than the second scoreline is proximate to the first end.

7. The strap of claim 6, wherein the first and second scorelines are parallel to one another.

8. The strap of claim 1, further comprising an elongated strip extending in the first direction between a first and second strip ends, wherein the first and second strip ends are attached to two the elongated body in the space between the scorelines, to form a second channel defined by the elongated body and the elongated strip, the second channel being sized to accommodate the tie.

9. The strap of claim 8, wherein the first and second strip ends are glued to the elongated body.

* * * * *